US011204040B2

(12) United States Patent
Tian et al.

(10) Patent No.: US 11,204,040 B2
(45) Date of Patent: Dec. 21, 2021

(54) CENTRIFUGAL FAN BLADE ASSEMBLY AND CENTRIFUGAL FAN

(71) Applicant: GREE ELECTRIC APPLIANCES, INC. OF ZHUHAI, Zhuhai (CN)

(72) Inventors: Yasong Tian, Guangdong (CN); Jianjian Li, Guangdong (CN); Jun Xiong, Guangdong (CN); Junhong Wu, Guangdong (CN); Dawei Li, Guangdong (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 0 days.

(21) Appl. No.: 16/468,470

(22) PCT Filed: Oct. 13, 2017

(86) PCT No.: PCT/CN2017/106028
§ 371 (c)(1),
(2) Date: Jun. 11, 2019

(87) PCT Pub. No.: WO2018/107883
PCT Pub. Date: Jun. 21, 2018

(65) Prior Publication Data

US 2020/0072233 A1 Mar. 5, 2020

(30) Foreign Application Priority Data

Dec. 16, 2016 (CN) ..... 201611169462.1

(51) Int. Cl.
*F04D 29/30* (2006.01)
*F04D 29/28* (2006.01)
*F04D 29/66* (2006.01)

(52) U.S. Cl.
CPC ..... *F04D 29/282* (2013.01); *F04D 29/30* (2013.01); *F04D 29/663* (2013.01); *F05D 2240/303* (2013.01)

(58) Field of Classification Search
CPC ..... F04D 29/282; F04D 29/30; F04D 29/663; F05D 2240/303
(Continued)

(56) References Cited

U.S. PATENT DOCUMENTS 5,337,568 A * 8/1994 Lee ..... F01D 5/18 416/236 R
6,139,258 A 10/2000 Lang, III et al.
(Continued)

FOREIGN PATENT DOCUMENTS

AU 2014200103 A1 1/2014
CN 200943602 Y 9/2007
(Continued)

OTHER PUBLICATIONS

Shigenaga, JP2007010259A English Translation, 2007 (Year: 2007).*
Extended European Search Report for EP App. No. 17881703.7 dated Nov. 15, 2019 (6 pages).

*Primary Examiner* — Eldon T Brockman
*Assistant Examiner* — Michael L Sehn
(74) *Attorney, Agent, or Firm* — Brandon V. Zuniga; James R. Gourley; Carstens & Cahoon, LLP

(57) ABSTRACT

Disclosed are a centrifugal fan blade assembly and a centrifugal fan, comprising a plurality of blades, a blade leading edge of at least some of the blades being provided with an interference groove, the interference groove extending in a width direction of the blade. By providing the interference groove extending in the width direction of the blade on the blade leading edge, when the fan blade assembly is running, the interference groove changes noise frequency, thereby preventing the blade leading edge from producing a rela-
(Continued)

11a tively large broadband noise after being impacted by a high speed air flow, thus effectively reducing noise.

10 Claims, 5 Drawing Sheets

(58) Field of Classification Search
USPC ..... 416/236 R
See application file for complete search history.

(56) References Cited

U.S. PATENT DOCUMENTS

| | | | | |
|---|---|---|---|---|
| 8,007,240 | B2 * | 8/2011 | Sanagi | F04D 29/282 416/186 R |
| 8,105,030 | B2 * | 1/2012 | Abdel-Messeh | F01D 5/187 416/95 |
| 2013/0101405 | A1 | 4/2013 | Shiraichi et al. | |
| 2013/0323098 | A1 * | 12/2013 | Ooya | F04D 29/681 417/410.1 |
| 2015/0152875 | A1 * | 6/2015 | Kamiya | F04D 29/667 416/147 |

FOREIGN PATENT DOCUMENTS

| | | | |
|---|---|---|---|
| CN | 202789715 | U | 3/2013 |
| CN | 104500444 | A | 4/2015 |
| CN | 105257592 | A | 1/2016 |
| CN | 106050736 | A | 10/2016 |
| CN | 106762816 | A | 5/2017 |
| CN | 206409426 | U | 8/2017 |
| JP | 2007010259 | A | 1/2007 |

* cited by examiner

CENTRIFUGAL FAN BLADE ASSEMBLY AND CENTRIFUGAL FAN

TECHNICAL FIELD

The disclosure relates to the field of a centrifugal fan, and particularly, to a centrifugal fan blade assembly and a centrifugal fan.

BACKGROUND

When the device having a centrifugal fan blade assembly runs, air flows impact one another, and air flows impact objects as well, which will result in aerodynamic noise, thus affecting people's daily work and study.

The aerodynamic simulation and calculation are performed for the fan blade assembly, and it is found that the maximum value of its broadband noise is generated at the leading edge of the blade. The structure of the leading edge is thin and sharp, and it is easy to generate large broadband noise after being impacted by a high-speed air flow.

SUMMARY OF THE INVENTION

The objective of the present invention is to provide a centrifugal fan blade assembly and a centrifugal fan which are capable of reducing noise.

The present invention provides a centrifugal fan blade assembly including a plurality of blades, wherein a leading edge of at least some of the blades is provided with an interference groove extending in a width direction of the blade.

Further, the interference groove is a V-shaped groove.

Further, an apex angle of the V-shaped groove is $\alpha$, wherein $30° \leq \alpha \leq 85°$.

Further, a groove depth of the V-shaped groove is h, wherein $0\ mm < h \leq 3\ mm$.

Further, each of the blades is provided with a plurality of interference grooves.

Further, a distance between two adjacent interference grooves is d, wherein, $0\ mm < d \leq 1\ mm$.

Further, three interference grooves are provided, and the three interference grooves are evenly distributed on the leading edge of the blade.

The present invention further provides a centrifugal fan, comprising the centrifugal fan blade assembly above.

According to the centrifugal fan blade assembly and the centrifugal fan of the present invention, the leading edge of the blade is provided with the interference groove extending in the width direction of the blade. When the blade operates, the interference groove changes the noise frequency and prevents the leading edge of the blade from generating large broadband noise after being impacted by the high-speed air flow, thereby effectively reducing noise.

BRIEF DESCRIPTION OF THE DRAWINGS

The accompanying drawings constituting a part of the present application are provided for a further understanding of the present invention. The illustrative embodiments of the present invention and the description are used to explain the present invention, but not intended to limit the present invention. In the drawings.

Figure 1:
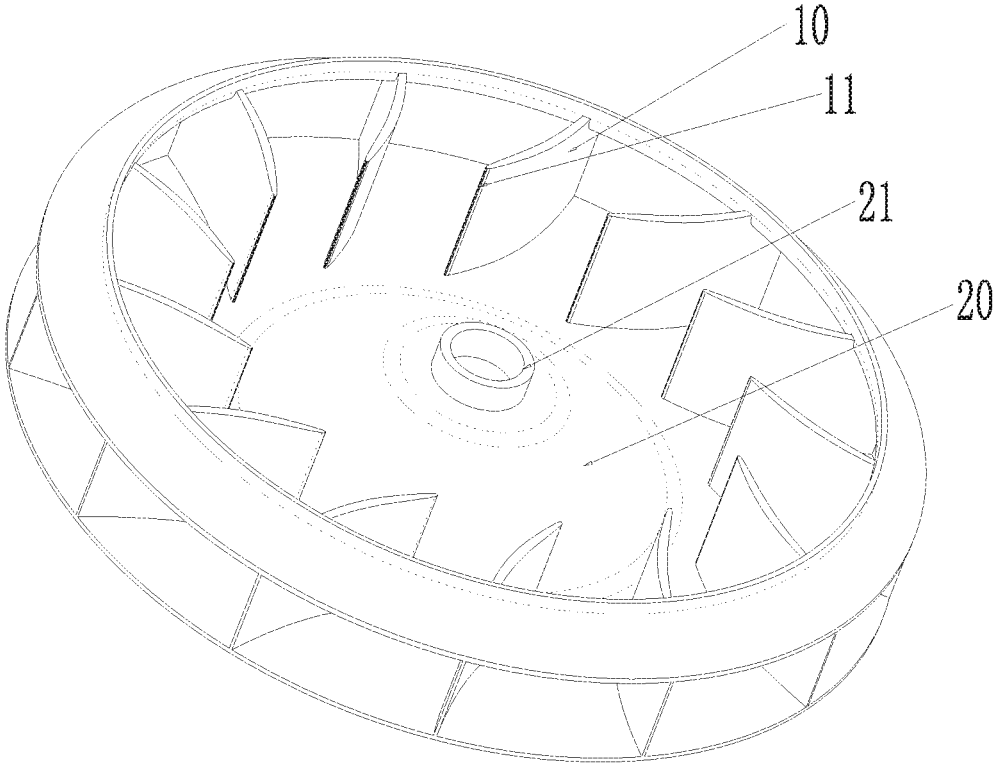
FIG. 1 is a perspective structural schematic view of a centrifugal blade assembly according to the present invention.
Figure 2:
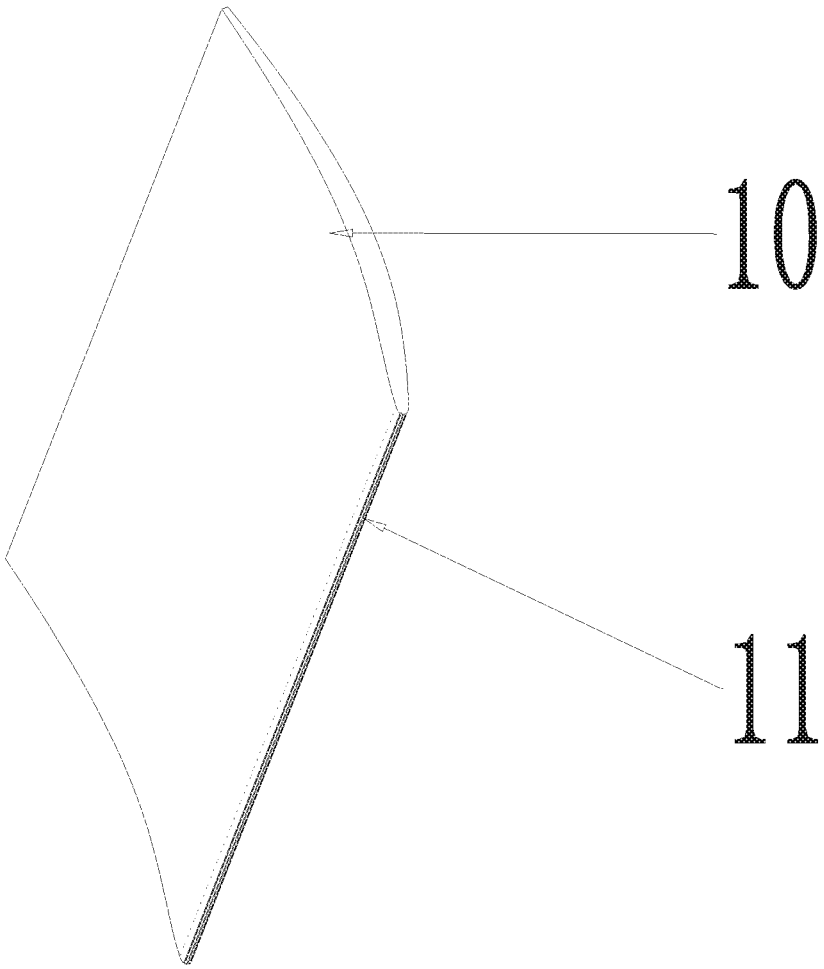
FIG. 2 is a perspective structural schematic view of a blade according to the present invention.
Figure 3:
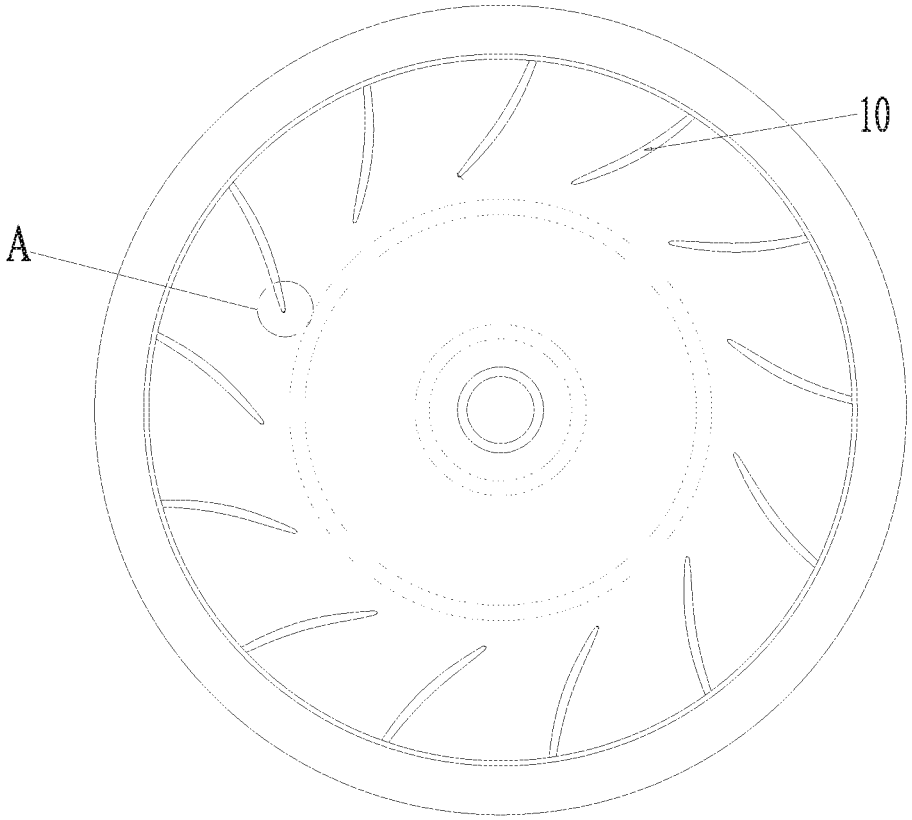
FIG. 3 is a structural schematic front view of the centrifugal fan blade assembly according to the present invention.

Wherein, the above figures include the following reference numerals:

10. blade; 11. leading edge of blade; 11*a*. interference groove;

20. wheel boss; 21. through opening.

DETAILED DESCRIPTION OF THE PREFERRED EMBODIMENTS

The present disclosure will be described in more details with reference to the accompanying figures and embodiments.

As shown in FIGS. 1 to 5, the centrifugal fan blade assembly of the present disclosure includes a plurality of blades 10, and the leading edge 11 of at least some of the blades 10 is provided with an interference groove 11*a* extending in the width direction of the blade 10. In the specific configuring process, all of the blades 10 may be provided with interference grooves 11*a*; or only some of the blades 10 are provided with interference grooves, for example in an alternate manner; or different blades 10 are provided with different numbers or types of interference grooves 11*a*, which are arranged in accordance with a particular regularity. According to the present disclosure, the leading edge 11 of the blade is provided with the interference groove 11*a* extending in the width direction of the blade 10, and the interference grooves 11*a* form a groove structure which is arranged according to a certain shape or regularity. When the blade operates, the air flow is disturbed at the interference groove 11*a*, which changes the noise frequency and prevents the leading edge 11 of the blade from generating large broadband noise after being impacted by the high-speed air flow, thereby effectively reducing noise.

Preferably, the interference groove 11*a* is a V-shaped groove, which can more effectively prevent the generation of broadband noise, thereby reducing the noise decibel more effectively. Preferably, the apex angle O of the V-shaped groove is $\alpha$, and when the value of $\alpha$ has a range of $30° \leq \alpha \leq 85°$, the effect of reducing noise is more significant. In addition, the groove depth of the V-shaped groove is h, and when the value of h has a range of $0\ mm < h \leq 3\ mm$, not only can the effect of reducing noise can be ensured, but also the machining is convenient.

Figure 4:
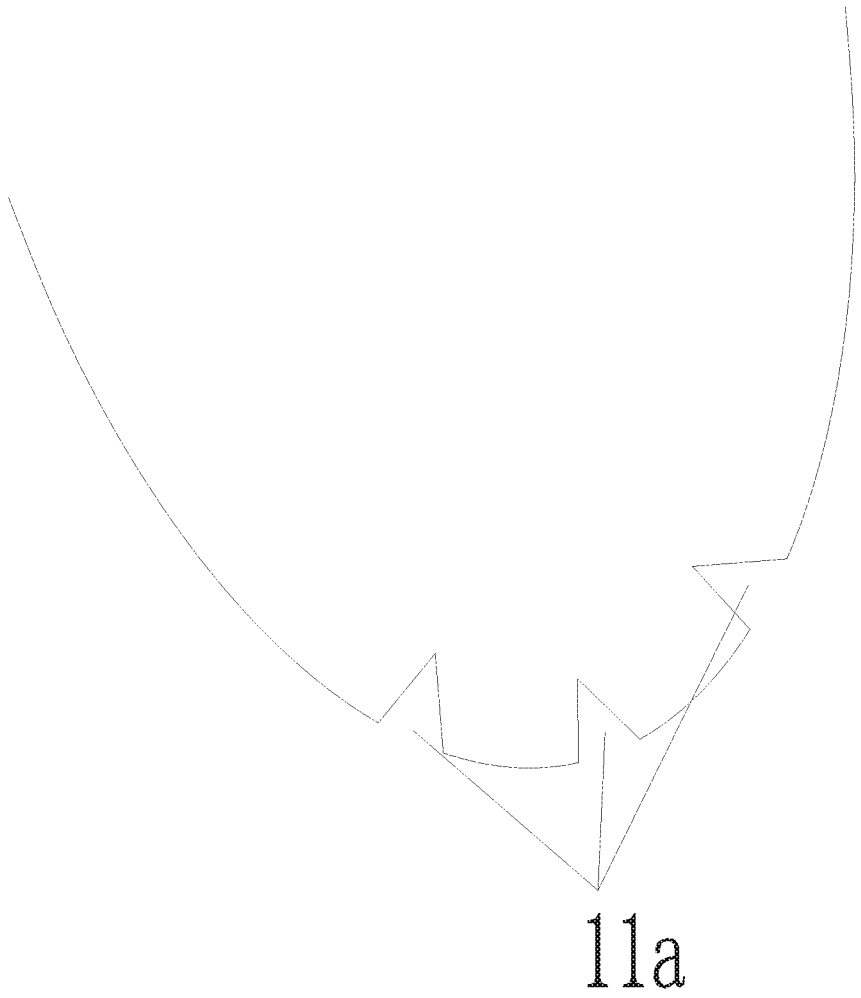
FIG. 4 is a partial enlarged view of the location marked with A shown in FIG. 3.
Figure 5:
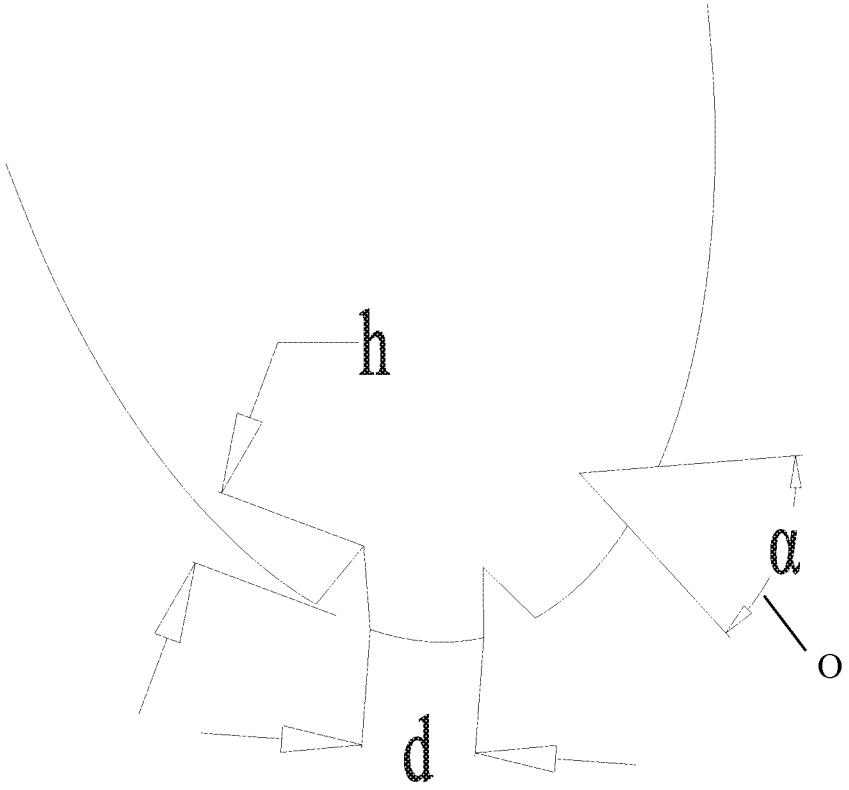
FIG. 5 is a schematic view with dimension indications of the partial enlarged view shown in FIG. 4.

As shown in FIG. 4 and FIG. 5, each blade is provided with a plurality of interference grooves 11*a*, and the plurality of interference grooves 11*a* are arranged to form a zigzag structure, which is more favorable for reducing noise. Preferably, the distance between two adjacent interference grooves 11*a* is d, wherein, when $0\ mm < d \leq 1\ mm$, the effect of reducing noise is better. In the specific embodiment shown in FIG. 4, three interference grooves 11*a* are provided, and the three interference grooves 11*a* are evenly distributed on the leading edge 11 of the blade.

In an embodiment of the present invention, a through opening 21 is disposed in the center of the rear disc, which is namely a wheel center structure. As shown in FIG. 1, the wheel boss 20 protrudes upwardly, so that sufficient space is ensured for installing a motor.

According to the aerodynamic simulation and calculation for the centrifugal fan blade assembly, the maximum broadband noise of the blade of a conventional centrifugal fan is mostly distributed at the thin and sharp leading edge. At a certain speed, the maximum value of the broadband noise reaches 65.0 dB. With the design of the above embodiment, at the same speed, the maximum value of the broadband noise is 61.2 dB, which is 3.8 dB lower than that of the blade of the conventional centrifugal fan.

The present disclosure also provides a centrifugal fan, including the foregoing centrifugal fan blade assembly, thereby effectively reducing noise.

From the above description, it can be seen that the foregoing embodiments of the present invention achieve the following technical effects:

According to the centrifugal fan blade assembly and the centrifugal fan of the present disclosure, the leading edge 11 of the blade is provided with the interference groove 11*a* extending in the width direction of the blade 10. When the blade operates, the interference groove 11*a* changes the noise frequency and prevents the leading edge 11 of the blade from generating large broadband noise after being impacted by the high-speed air flow, thereby effectively reducing noise.

What described above are preferred embodiments of the present invention, but not intended to limit the present invention. For those skilled in the art, various amendments and modifications can be made. Any modifications, equivalent substitutions and improvements made within the spirits and principles of the present invention are all within the protection scope of the present invention.

What is claimed is:

1. A centrifugal fan blade assembly, comprising a plurality of blades, a rear disc and a front disc, wherein:

the front disc and the rear disc are arranged coaxially;

a first edge of each blade of the plurality of blades is fixedly arranged between the front disc and the rear disc and parallel with a rotating axis of the centrifugal fan blade assembly;

the rotating axis of the centrifugal fan blade assembly passes through a through opening disposed in a center of the rear disc;

a leading edge of each blade of the plurality of blades is opposite to the first edge of each corresponding blade of the plurality of blades;

at least some of the leading edges each are provided with an interference groove extending along a corresponding leading edge of the at least some of the leading edges, extending in a direction parallel with the rotating axis of the centrifugal fan blade assembly, and going through the corresponding leading edge;

the interference groove is a V-shaped groove; and an apex angle of the V-shaped groove is $\alpha$, wherein 30° a 85°.

2. The centrifugal fan blade assembly according to claim 1, wherein a groove depth of the V-shaped groove is h, wherein 0 mm<h≤3 mm.

3. The centrifugal fan blade assembly according to claim 1, wherein each blade of the plurality of blades is provided with a plurality of interference grooves.

4. The centrifugal fan blade assembly according to claim 3, wherein a distance between two adjacent interference grooves of the plurality of interference grooves is d, wherein 0 mm<d≤1 mm.

5. The centrifugal fan blade assembly according to claim 3, wherein three interference grooves are provided on the leading edge of the blade, and distances between adjacent grooves of the three interference grooves are identical.

6. A centrifugal fan, comprising the centrifugal fan blade assembly defined in claim 1.

7. The centrifugal fan according to claim 6, wherein a groove depth of the V-shaped groove is h, wherein 0 mm<h≤3 mm.

8. The centrifugal fan according to claim 6, wherein each blade of the plurality of blades is provided with a plurality of interference grooves.

9. The centrifugal fan according to claim 8, wherein a distance between two adjacent interference grooves of the plurality of interference grooves is d, wherein 0 mm<d≤1 mm.

10. The centrifugal fan according to claim 8, wherein three interference grooves are provided on the leading edge of the blade, and distances between adjacent grooves of the three interference grooves are identical.

* * * * *